US007022169B2

(12) United States Patent
Iwai et al.

(10) Patent No.: US 7,022,169 B2
(45) Date of Patent: Apr. 4, 2006

(54) ELECTROLESS GOLD PLATING SOLUTION

(75) Inventors: Ryota Iwai, Saitama (JP); Tomoaki Tokuhisa, Saitama (JP); Masaru Kato, Saitama (JP)

(73) Assignee: Kanto Kagaku Kabushiki Kaisha, Tokyo (JP)

( * ) Notice: Subject to any disclaimer, the term of this patent is extended or adjusted under 35 U.S.C. 154(b) by 87 days.

(21) Appl. No.: 10/732,323

(22) Filed: Dec. 10, 2003

(65) Prior Publication Data

US 2004/0118317 A1 Jun. 24, 2004

(30) Foreign Application Priority Data

Dec. 10, 2002 (JP) ..... 2002-357720

(51) Int. Cl.
*C23C 18/42* (2006.01)
*C23C 18/44* (2006.01)
*B05D 1/18* (2006.01)

(52) U.S. Cl. ..... 106/1.23; 106/1.26; 427/443.1

(58) Field of Classification Search ..... 106/1.23, 106/1.26; 427/443.1

See application file for complete search history.

(56) References Cited

U.S. PATENT DOCUMENTS

| | | | | |
|---|---|---|---|---|
| 3,793,038 | A * | 2/1974 | Maguire | 427/443.1 |
| 6,773,573 | B1 * | 8/2004 | Gabe et al. | 205/296 |
| 6,855,191 | B1 * | 2/2005 | Kato et al. | 106/1.23 |
| 2003/0102226 | A1 * | 6/2003 | Gabe et al. | 205/263 |

FOREIGN PATENT DOCUMENTS

| | | | |
|---|---|---|---|
| JP | 3-294484 | A | 12/1991 |
| JP | 6-145996 | A | 5/1994 |
| JP | 2001-192886 | A | 7/2001 |
| WO | WO 00/28108 | * | 5/2000 |

OTHER PUBLICATIONS

Honma, H., et al., "Electroless Gold Plating by Disulfiteaurate Complex, " Plating & Surface Finishing, vol. 82, No. 4, 89-92, Apr. 1995.

* cited by examiner

*Primary Examiner*—Helene Klemanski
(74) *Attorney, Agent, or Firm*—Wolf, Greenfield & Sacks, P.C.

(57) ABSTRACT

An electroless gold plating solution is provided that contains no cyanide compound as a source of gold and that contains a decomposition inhibitor represented by general formula (1), provided that, in a case in which the solution contains a gold complex of sulfite and the decomposition inhibitor is cytosine, the pH 6.0 or less is excluded.

(1)

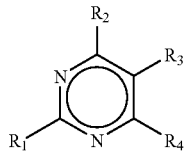

In the formula, $R_1$ to $R_4$ denote hydrogen atom(s), alkyl group(s) having 1 to 10 carbon atom(s), which may have substituent(s), aryl group(s) having 6 to 10 carbon atoms, which may have substituent(s), alkoxy group(s) having 1 to 10 carbon atom(s), which may have substituent(s), amino group(s) (—$NH_2$), hydroxyl group(s) (—OH), ═O, or halogen atom(s), $R_2$ and $R_3$ or $R_3$ and $R_4$ may crosslink with each other and form a saturated or unsaturated ring and the saturated or unsaturated ring may include oxygen, sulfur or nitrogen atom(s), each of the above-mentioned substituents may be a halogen atom or a cyano group, and

⁻⁻⁻⁻⁻ may be a single bond or a double bond.

11 Claims, No Drawings

ELECTROLESS GOLD PLATING SOLUTION

BACKGROUND OF THE INVENTION

1. Field of the Invention

The present invention relates to an electroless gold plating solution for use in formation of a gold plate coating on an industrial electronic component such as a printed wiring board.

2. Description of the Related Art

A printed wiring board generally has a metal circuit pattern on and/or within the board, a metal such as copper, which has a low electrical resistance, is used for the circuit, and an exposed copper area is covered with nickel or a nickel alloy and further with gold. The nickel or the nickel alloy is used as a barrier metal for preventing oxidation and corrosion of the copper circuit and/or preventing migration of copper and gold and, moreover, the gold coating is formed in order to suppress oxidation of the nickel or the nickel alloy, maintain reliability of contacts, improve solderability, etc. When such a circuit is formed, plating with nickel or a nickel alloy is carried out after forming the copper pattern, and there is then further carried out gold electroplating, autocatalytic gold plating after displacement gold plating, or thick displacement gold plating after the nickel or nickel alloy. With regard to the autocatalytic gold plating, there has been a desire for a composition containing no hazardous cyanide compound, and in recent years cyanide-free autocatalytic electroless gold plating has started to be used.

Since in cyanide-free autocatalytic electroless gold plating there is no cyanide compound, which forms a stable complex with gold in aqueous solution, the solution cannot be kept stable, and the problem of gold particles forming in the solution or in the vicinity of the walls of a container containing the solution, that is, bath decomposition, easily occurs. The complex stability constants of, for example, a gold sulfite complex and a gold cyanide complex in aqueous solution are $10^{-10}$ and $10^{-38}$ respectively, and the gold cyanide complex is far more stable. Since the autocatalytic electroless gold plating is used in industrial electronic components such as printed wiring boards, it is preferable that the gold coverage capacity for a target area is stable. There is therefore a desire for cyanide-free autocatalytic electroless gold plating in which there is no bath decomposition or hardly any bath decomposition, and which can be used stably.

As a measure against the problem of bath decomposition occurring in a cyanide-free electroless gold plating solution containing, for example, sulfite—thiosulfate as a complexing agent, there is known a method 1) in which a compound that can form a complex with gold or with an impurity metal ion that is a main cause of decomposition is added so as to make the solution stable (JP, A, 3-294484), and a method 2) in which a compound that is adsorbed on the surface of gold to thereby suppress gold deposition due to autocatalytic action is added so as to make the solution stable (JP, A, 6-145996).

However, in the case of method 1), the deposition potential of gold changes, and the physical properties that would allow it to be used as a circuit cannot be obtained. In the case of method 2), the effect of suppressing gold deposition is too strong, excessive addition degrades the deposition characteristics in detailed areas, and if the effect is excessive gold is prevented from depositing at all, meaning that the concentration of the compound added has to be set precisely, which is a problem.

On the other hand, an example of electroless gold plating employing cytosine as a decomposition inhibitor has been reported by H. Honma et al., (Plating and Surface Finishing, Vol. 82, No. 4, 89–92 (1995)), in which it is reported that a bath can be stabilized by adding 0.1 to 100 mg/L of cytosine at a pH of 6.0.

However, in this publication only the effect of stabilizing a bath by cytosine is described, there is no clear indication of the influence on gold deposition in detailed areas of a printed wiring board, etc. or on the physical properties of the gold plate coating, and in the above-mentioned range the concentration of cytosine after heating could hardly be detected and the effect in stabilizing a gold plating solution was not sufficient. Even increasing the concentration of cytosine added could not give a sufficient stabilizing effect in practice.

As an example of a compound similar to cytosine being added to a plating solution, there is a case of a gold—tin alloy plating bath (JP, A, 2001-192886). This is for electroplating, and the compound is added mainly for the purpose of suppressing variation in the alloy composition and not for the purpose of suppressing bath decomposition.

SUMMARY OF THE INVENTION

It is therefore an object of the present invention to provide an electroless gold plating solution employing a decomposition inhibitor that can solve the above-mentioned problems regarding the stability of the electroless gold plating solution and that does not suppress gold deposition too excessively.

As a result of an intensive investigation in order to solvent the above-mentioned problems, the present inventors have found that use of a compound having a certain specific skeleton as a decomposition inhibitor can stabilize the solution without suppressing the gold deposition rate even when a cyanide compound is not used as a source of gold, and the present invention has thus been accomplished.

That is, the present invention relates to an electroless gold plating solution that contains no cyanide compound as a source of gold and that contains a decomposition inhibitor represented by general formula (1), (provided that in a case in which the solution contains a gold complex of sulfite and the decomposition inhibitor is cytosine, the pH 6.0 or less is excluded).

(1)

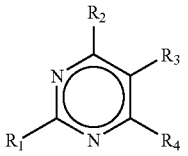

In the formula, $R_1$ to $R_4$ denote hydrogen atom(s), alkyl groups having 1 to 10 carbon atom(s), which may have substituent(s), aryl group(s) having 6 to 10 carbon atoms, which may have substituent(s), alkoxy group(s) having 1 to 10 carbon atom(s), which may have substituent(s), amino group(s) (—$NH_2$), hydroxyl group(s) (—OH), =O, or halogen atom(s), $R_2$ and $R_3$ or $R_3$ and $R_4$ may crosslink with each other and form a saturated or unsaturated ring and the saturated or unsaturated ring may include oxygen, sulfuer or nitrogen atom(s), each of the above-mentioned substituents may be a halogen atom or a cyano group, and may be a single bond or a double bond.

Furthermore, the present invention relates to the electroless gold plating solution wherein the decomposition inhibitor is cytosine or 5-methylcytosine.

Moreover, the present invention relates to the electroless gold plating solution wherein the rate of gold deposition on a substrate metal is 60% to 100% of that when no decomposition inhibitor is added.

Furthermore, the present invention relates to the electroless gold plating solution wherein it further includes a complexing agent, a source of gold, and a reducing agent.

Moreover, the present invention relates to the electroless gold plating solution wherein the source of gold is selected from the group consisting of a gold complex of sulfite, a gold complex of thiosulfate, chloroauric acid or a salt thereof, a thiourea gold complex salt, a gold complex salt of thiomalic acid, and a gold iodide salt.

Furthermore, the present invention relates to an electroless gold plating method wherein electroless gold plating is carried out by dipping a material to be plated in the above-mentioned electroless gold plating solution.

The electroless gold plating solution of the present invention contains a reducing agent that can deposit gold by catalysis on a substrate metal, and it can be used stably even when a cyanide compound is not used as the source of gold.

Furthermore, since the electroless gold plating solution of the present invention contains a compound having a certain specific skeleton, in particular, a cytosine skeleton although the mechanism is not clear, even when an excess amount of decomposition inhibitor is added, deposition in detailed areas is not degraded, the gold deposition reaction is not excessively suppressed, and the deposition rate is not suppressed by 40% or more relative to that when no decomposition inhibitor is added. It is therefore unnecessary to set the addition concentration precisely, management of the concentration is easy, and it is preferable in practice.

Moreover, use of the electroless gold plating solution of the present invention makes it possible to carry out gold plating with good deposition properties in detailed areas of a printed wiring board, etc. and good physical properties that enables it to be used as a circuit, and it is an excellent electroless plating solution in practice.

MODES FOR CARRYING OUT THE INVENTION

The electroless gold plating solution of the present invention is explained in detail below.

The electroless gold plating solution of the present invention can be applied to substrate catalysis type electroless gold plating, autocatalytic electroless gold plating, etc., and can be used even in a case where no cyanide is present.

Thick displacement gold plating is carried out using an electroless gold plating solution containing a source of gold, a complexing agent, a pH buffering agent, a reducing agent, a stabilizer, etc.

Examples of a substrate metal include gold, nickel, palladium, platinum, silver, cobalt, an alloy thereof, and an alloy thereof with a nonmetallic element such as phosphorus or boron.

A decomposition inhibitor contained in the electroless gold plating solution of the present invention is represented by general formula (1), suppresses bath decomposition, and does not degrade deposition in detailed areas even when it is added in excess.

Each of the substituents in general formula (1) denotes a hydrogen atom, a hydroxyl group, an amino group, =O, an alkyl group having 1 to 10 carbon atom(s) such as methyl, ethyl, or propyl, an aryl group having 6 to 10 carbon atoms such as phenyl or xylyl, an alkoxy group having 1 to 10 carbon atom(s) such as methoxy, ethoxy, or propoxy, or a halogen atom such as F, Cl, Br, or I. These substituents may all be identical to or different from each other, and they may further have substituent(s) such as a halogen or a cyano group.

$R_2$ and $R_3$ or $R_3$ and $R_4$ in general formula (1) may crosslink with each other to form a saturated or unsaturated ring; examples of the saturated ring include a cyclohexane ring and a cyclopentane ring, and examples of the unsaturated ring include a benzene ring and a hetero ring such as a pyridine ring, a pyrrole ring, or a pyrimidine ring.

As specific compounds, there can be cited cytosine, 5-methylcytosine, pyrimidine, oxymethylcytosine, aminopyrimidine, etc. From the viewpoint of long term stability of the gold plating solution, cytosine and 5-methylcytosine, which have a cytosine skeleton, are particularly preferable.

An electroless gold plating solution that employs a gold complex of sulfite as the source of gold, cytosine as the decomposition inhibitor, and has a pH of 6.0 or less is not included in the electroless gold plating solution of the present invention. In the presence of sulfite under acidic conditions, cytosine is rapidly depleted due to sulfonation and subsequent deamination, the overall stability of the solution can be expected to decrease, and adequate effects are not obtained. Therefore, when the above-mentioned decomposition inhibitor and the above-mentioned source of gold are used, the pH is preferably set at 6.5 or higher so as to suppress the sulfonation.

The concentration of the decomposition inhibitor is preferably from 100 mg/L to the upper solubility limit. When cytosine is used as the decomposition inhibitor, its concentration is preferably from 100 mg/L to the upper solubility limit, more preferably 500 to 5000 mg/L, and most preferably 1000 to 3000 mg/L. When it is less, although the effect of stabilizing the bath can be shown, it is difficult to obtain a practical stability, and maintenance of the concentration is also difficult.

A compound containing the —SH structure such as 2-mercaptobenzothiazole (MBT), 2-mercaptobenzoimidazole (MBI), or mercaptoacetic acid can also be used in combination in the decomposition inhibitor in a range that does not affect other components, but since it might make the bath unstable due to a reaction resulting from combination with the reducing agent or other components or might suppress the deposition of gold excessively, it is necessary to give careful consideration to the selection thereof. Furthermore, among nitrogen-containing cyclic compounds, since there are those, such as 2,2'-bipyridyl and 1,10-phenanthrolinium chloride, that excessively suppress the deposition of gold, addition of an excess amount thereof should be avoided.

When MBT or MBI is used in combination, the concentration range thereof is preferably 10 mg/L or less, and more preferably 1 mg/L or less. Since they have a strong effect in suppressing the deposition of gold in comparison with cytosine, if they are added in excess, the gold deposition rate becomes excessively low, and it is therefore preferable not to use them in combination if possible.

The gold deposition rate in the present invention may be 60% to 100% of that when no decomposition inhibitor is added, preferably 80% to 100%, and more preferably 95% to 100%.

The source of gold used in the present invention is a water-soluble gold compound containing no cyanide, and examples thereof include a gold complex of sulfite, a gold complex of thiosulfate, chloroauric acid, a thiourea gold complex salt, a gold complex salt of thiomalic acid, and a gold iodide salt.

Other than the thiourea gold complex salt, the source of gold can be in the form of any of an alkali metal salt, an alkaline earth metal salt, an ammonium salt, etc., and the thiourea gold complex salt may be in the form of a salt of perchloric acid, hydrochloric acid, etc.

Specifically, examples of the gold complex of sulfite include sodium gold sulfite denoted by $Na_3Au(SO_3)_2$ and potassium gold sulfite, examples of the gold complex of thiosulfate include gold sodium thiosulfate denoted by $Na_3Au(S_2O_3)_2$ and gold potassium thiosulfate, examples of the salt of chloroauric acid include sodium chloroaurate and potassium chloroaurate, examples of the thiourea gold complex salt include thiourea gold hydrochloride and thiourea gold perchlorate, and examples of the gold complex salt of thiomalic acid include gold sodium thiomalate and gold potassium thiomalate. These gold sources may be used singly or in a combination of two or more types. For example, when sodium gold sulfite is used as the source of gold, the concentration range thereof is preferably 0.001 to 0.5 mol/L as the gold concentration, and more preferably 0.001 to 0.1 mol/L.

The gold plating solution of the present invention enables gold plating due to autocatalysis to be carried out effectively by appropriately selecting the reducing agent, the complexing agent, the stabilizer, etc. even when a gold salt containing no cyanide is used.

Specific examples of the complexing agent include compounds that can form a complex with monovalent or trivalent gold, such as sulfite, thiosulfate, and a sulfite and a thiosulfate of an alkali metal such as sodium or potassium or an alkaline earth metal such as calcium or magnesium. For example, when potassium sulfite and sodium thiosulfate are used as the complexing agents, the concentration ranges thereof are preferably 0.05 to 2.0 mol/L and 0 to 1.0 mol/L respectively, and more preferably 0.1 to 0.8 mol/L and 0.04 to 0.2 mol/L, and the preferred composition ratio thereof is in the range of 1:0.1 to 1. The concentration of the complexing agent depends on the concentration of gold, and is adjusted as appropriate while taking into consideration the stability toward gold ions, the stability of the bath, the solubility, the viscosity of the bath, etc. In particular, the reducing effect of thiosulfate increases the deposition rate but makes the bath unstable at the same time, and also degrades the adhesion, and when it is used in an amount more than the above-mentioned range, there are more disadvantages than benefits.

Examples of the pH buffering agent include a phosphate, a tetraborate, a borate, etc. of an alkali metal such as sodium or potassium or an alkaline earth metal such as calcium or magnesium. Specific examples thereof include dipotassium hydrogen phosphate, disodium hydrogen phosphate, potassium dihydrogen phosphate, sodium dihydrogen phosphate, potassium tetraborate, and sodium tetraborate. When dipotassium hydrogen phosphate and potassium tetraborate are used as the pH buffering agents, the concentration ranges thereof are 0.01 to 1.0 mol/L and 0.001 to 0.12 mol/L respectively, and preferably 0.02 to 0.50 mol/L and 0.01 to 0.1 mol/L. They are used as a mixture or singly, and care should be taken since the buffer effect varies depending on the pH employed. Specifically, when it is used in the vicinity of pH 8.5 to 10, compared with tetraboric acid the pH is not stable in the phosphoric acid buffer solution, and it is preferable to use a mixture of phosphoric acid and tetraboric acid or to use tetraboric acid alone. In contrast, when the pH is in the vicinity of 7, since a phosphoric acid buffer solution is more stable, the phosphoric acid buffer solution is used preferentially. Moreover, depending on the type of substrate metal, it might cause oxidation of the coating and greatly degrade the plating appearance, and when used care should be taken on this point.

As the pH adjusting agent, for example, an inorganic acid such as sulfuric acid, hydrochloric acid, or phosphoric acid, a hydroxide such as sodium hydroxide or potassium hydroxide and, in a range that does not affect other components, an amine such as ammonia or tetramethylamine hydroxide, which are denoted by $NR_4OH$ (R: hydrogen or alkyl), can be used. When, for example, a phosphoric acid buffer solution is used, phosphoric acid, sulfuric acid and sodium hydroxide or potassium hydroxide are preferably used as the pH adjusting agents.

The pH of the electroless gold plating solution used in the present invention is preferably 6.5 or higher, and it is preferably in the range of 6.5 to 10 so as to suit the composition to the extent that the action of the reducing agent is not too strong, more preferably 7.1 to 9.5, and most preferably 7.2 to 9.0.

With regard to a reducing agent that has a catalytic activity toward gold, a standard reducing agent can be used. Examples thereof include an ascorbate such as sodium ascorbate, hydroxylamine, a salt of hydroxylamine such as hydroxylamine hydrochloride or hydroxylamine sulfate, a hydroxylamine derivative such as hydroxylamine-O-sulfonic acid, hydrazine, an amine borane compound such as dimethylamine borane, a borohydride compound such as sodium borohydride, a saccharide such as glucose, and a hypophosphite, and they are used singly or as a mixture. In addition, any compound can be used as long as it can be determined, using the Nernst equation, that it is able to reduce and deposit gold from gold ions or a gold complex, but it is used while taking into consideration the reactivity toward other bath components and the stability of the bath. Furthermore, among these reducing agents, those such as hydrazine that might be harmful to humans are included, and it is necessary to make the selection according to the intended purpose and the application environment when they are used.

For example, when the substrate metal is gold and an ascorbate is used as the reducing agent, the concentration range thereof is 0.001 to 2.0 mol/L, and preferably 0.001 to 0.5 mol/L. When the concentration is low, the gold deposition rate is very slow, and a practical speed for thick displacement cannot be obtained. When it is high, the bath might be made unstable, and the amount used should be adjusted appropriately., Furthermore, for example, when the substrate metal is a nickel-phosphorus alloy and hydroxylamine hydrochloride is used as the reducing agent, the concentration range thereof is 1.0 mol/L or less, and preferably 0.005 to 0.3 mol/L. Although it depends on an accelerating agent and the stabilizer, when the amount of the reducing agent is low, the replacement reaction percentage is high, and the problem of substrate erosion easily occurs. When it is high, the autocatalytic action is too strong, and the bath is made unstable.

The temperature at which the electroless gold plating solution of the present invention is used, although depending on the reducing agent, is preferably in the range of 30° C. to 90° C., and more preferably 40° C. to 70° C.

The electroless gold plating solution of the present invention may contain as another additive a crystal grain shape adjusting agent, a brightening agent, etc. in an appropriate concentration range. Such additives are not particularly limited as long as they are conventionally used; specific examples of the crystal grain shape adjusting agent include polyethylene glycol, and specific examples of the brightening agent include thallium, copper, antimony, and lead. Other than those above, a composition that can satisfy the above-mentioned conditions can be used.

The electroless gold plating method according to the present invention involves dipping a material to be plated having the above-mentioned substrate metal at, for example, 60° C. for 1 hour, thus effecting the gold plating.

EXAMPLES

The electroless gold plating solution of the present invention is explained further in detail below with reference to examples and comparative examples, but the present invention is not limited thereto.

The coating thickness, the appearance, and the adhesion of the gold coating obtained using the electroless gold plating solution of the present invention and the stability of the plating solution were evaluated.

The coating thickness was measured using an X-ray fluorescence coating thickness meter manufactured by SII, the appearance was inspected visually and microscopically, and the adhesion was evaluated in a tape test based on JIS H8504 'Plating Adhesion Test Methods', and a bonding test. A copper plate was used as a plating test piece; it was subjected to Ni alloy plating by the procedure below and tested. The stability of the plating solution was evaluated by indirect heating in a bath at 62° C., inspecting the condition of the occurrence of micro particles using a particle counter, and measuring the time until the micro particles occurred.

Reference Example

Copper Plate Pretreatment

Degreasing (ICP Clean S-135, manufactured by Okuno Chemical Industries Co., Ltd.) 40° C., 5 min→etching (sodium persulfate 150 g/L, 98% sulfuric acid 2 mL/L) 1 min→dipping in 10 mL/L solution of 98% sulfuric acid 30 sec→dipping in 10 mL/L solution of 30% hydrochloric acid 30 sec→Pd catalyst formation (ICP Accera, manufactured by Okuno Chemical Industries Co., Ltd.) 30 sec→electroless Ni—P plating (ICP Nicoron GM, manufactured by Okuno Chemical Industries Co., Ltd., P content 6% to 8%, about 3 μm) 80° C., 20 to 30 min→displacement gold plating (Muden Gold AD, manufactured by Okuno Chemical Industries Co., Ltd., about 0.05 μm) 80° C., 10 min→electroless gold plating.

Example 1

An Ni—P coating was formed on a copper plate by the procedure of the reference example using ICP Nicoron GM manufactured by Okuno Chemical Industries Co., Ltd., then subjected to displacement gold plating using Muden Gold AD (manufactured by Okuno Chemical Industries Co., Ltd.), and subjected to electroless gold plating using solution No. 1 in Table 1.

As a result of dipping for 1 hr with stirring at 60° C., a bright yellow semigloss gold coating having a thickness of 0.9 μm was obtained. The coating thus obtained had a uniform appearance without unevenness, and did not peel off in a tape test, thus showing good adhesion. When a test circuit board with a wiring pattern was plated in the same manner, a bright yellow semigloss gold coating having no unevenness in detailed areas was obtained.

The stability was evaluated by further stirring at 60° C. with no load. No gold micro particles were formed even after 130 hours or more had elapsed, and good stability was thus exhibited.

In comparison with Comparative Example 1, the effects of the addition of cytosine on the stability and the gold deposition rate were confirmed.

Example 2

An Ni—P coating was formed on a copper plate by the procedure of the reference example using ICP Nicoron GM manufactured by Okuno Chemical Industries Co., Ltd., then subjected to displacement gold plating using Muden Gold AD (manufactured by Okuno Chemical Industries Co., Ltd.), and subjected to electroless gold plating using solution No. 2 in Table 1.

As a result of dipping for 1 hr with stirring at 60° C., a bright yellow semigloss gold coating having a thickness of 0.8 μm was obtained. The coating thus obtained had a uniform appearance without unevenness, and did not peel off in a tape test, thus showing good adhesion. When a test circuit board with a wiring pattern was plated in the same manner, a bright yellow semigloss gold coating having no unevenness in detailed areas was obtained.

The stability was evaluated by further stirring at 60° C. with no load. No gold micro particles were formed even after 130 hours or more had elapsed, and good stability was thus exhibited.

In comparison with Comparative Example 2, the effects of the addition of cytosine on the stability and the gold deposition rate were confirmed. The problem shown in Comparative Example 3, where addition of a thiol compound improved the bath stability but at the same time greatly degraded the deposition rate, was not observed. Furthermore, in the case of Comparative Example 4, although cytosine was added, since the pH of the bath was 6.0, sufficient stability could not be obtained.

Example 3

An Ni—P coating was formed on a copper plate by the procedure of the reference example using ICP Nicoron GM manufactured by Okuno Chemical Industries Co., Ltd., then subjected to displacement gold plating using Muden Gold AD (manufactured by Okuno Chemical Industries Co., Ltd.), and subjected to electroless gold plating using solution No. 3 in Table 1.

As a result of dipping for 1 hr with stirring at 60° C., a bright yellow semigloss gold coating having a thickness of 0.8 μm was obtained. The coating thus obtained had a uniform appearance without unevenness, and did not peel off in a tape test, thus showing good adhesion. When a test circuit board with a wiring pattern was plated in the same manner, a bright yellow semigloss gold coating having no unevenness in detailed areas was obtained.

The stability was evaluated by further stirring at 60° C. with no load. No gold micro particles were formed even after 130 hours or more had elapsed, and good stability was thus exhibited.

In comparison with Comparative Example 2, the effects of the addition of 5-methylcytosine on the stability and the gold deposition this example, the problem shown in Comparative Example 3, where addition of a thiol compound improved the bath stability but at the same time greatly degraded the deposition rate, was not observed.

Example 4

An Ni—P coating was formed on a copper plate by the procedure of the reference example using ICP Nicoron GM manufactured by Okuno Chemical Industries Co., Ltd., then subjected to displacement gold plating using Muden Gold AD (manufactured by Okuno Chemical Industries Co., Ltd.), and subjected to electroless gold plating using solution No. 4 in Table 1.

As a result of dipping for 1 hr with stirring at 60° C., a bright yellow semigloss gold coating having a thickness of 0.75 μm was obtained. The coating thus obtained had a uniform appearance without unevenness, and did not peel off in a tape test, thus showing good adhesion. When a test circuit board with a wiring pattern was plated in the same manner, a bright yellow semigloss gold coating having no unevenness in detailed areas was obtained.

The stability was evaluated by further stirring at 60° C. with no load. No gold micro particles were formed even after 130 hours or more had elapsed, and good stability was thus exhibited.

Even when 5000 mg/L of cytosine was added the deposition rate did not greatly decrease, as it did in Comparative Example 2 where no cytosine was added and Comparative Example 3 where the thiol compound was added, and the effects on the stability and the gold deposition rate were confirmed.

Example 5

An Ni—P coating was formed on a copper plate by the procedure of the reference example using ICP Nicoron GM manufactured by Okuno Chemical Industries Co., Ltd., and then subjected to electroless gold plating using solution No. 5 in Table 1.

As a result of dipping for 1 hr with stirring at 60° C., a bright yellow semigloss gold coating having a thickness of 0.2 μm was obtained. The coating thus obtained had a uniform appearance without unevenness, and did not peel off in a tape test, thus showing good adhesion. When a test circuit board with a wiring pattern was plated in the same manner, a bright yellow semigloss gold coating having no unevenness in detailed areas was obtained.

The stability was evaluated by further stirring at 60° C. with no load. No gold micro particles were formed even after 130 hours or more had elapsed, and good stability was thus exhibited.

This example confirmed the effect of the addition of cytosine on the stability and the gold deposition rate in comparison with Comparative Example 5-1 where no cytosine was added. Furthermore, the problem seen in Comparative Example 5-2 in which 1,10-phenanthrolinium chloride was added instead of cytosine, where although the bath was stabilized the plating did not proceed at all, was not observed.

Example 6

An Ni—P coating was formed on a copper plate by the procedure of the reference example using ICP Nicoron GM manufactured by Okuno Chemical Industries Co., Ltd., and then subjected to electroless gold plating using solution No. 6 in Table 1.

As a result of dipping for 1 hr with stirring at 60° C., a bright yellow semigloss gold coating having a thickness of 0.3 μm was obtained. The coating thus obtained had a uniform appearance without unevenness, and did not peel off in a tape test, thus showing good adhesion. When a test circuit board with a wiring pattern was plated in the same manner, a bright yellow semigloss gold coating having no unevenness in detailed areas was obtained.

The stability was evaluated by further stirring at 60° C. with no load. No gold micro particles were formed even after 130 hours or more had elapsed, and good stability was thus exhibited.

It was confirmed by this example that suppression of the gold deposition rate due to the addition of cytosine was small even under bath conditions where the deposition rate was comparatively low, and there was an effect in improving the stability of the bath in comparison with Comparative Example 6 where no cytosine was added.

Comparative Example 1

An Ni—P coating was formed on a copper plate by the procedure of the reference example using ICP Nicoron GM manufactured by Okuno Chemical Industries Co., Ltd., then subjected to displacement gold plating using Muden Gold AD (manufactured by Okuno Chemical Industries Co., Ltd.), and subjected to electroless gold plating using solution No. 1 in Table 2.

As a result of dipping for 1 hr with stirring at 60° C., a bright yellow semigloss gold coating having a thickness of 0.9 μm was obtained. The coating thus obtained had a uniform appearance without unevenness, and did not peel off in a tape test, thus showing good adhesion. When a test circuit board with a wiring pattern was plated in the same manner, a bright yellow semigloss gold coating having no unevenness in detailed areas was obtained.

The stability was evaluated by further stirring at 60° C. with no load. Gold micro particles were formed after 60 hours had elapsed.

Comparative Example 2

An Ni—P coating was formed on a copper plate by the procedure of the reference example using ICP Nicoron GM manufactured by Okuno Chemical Industries Co., Ltd., then subjected to displacement gold plating using Muden Gold AD (manufactured by Okuno Chemical Industries Co., Ltd.), and subjected to electroless gold plating using solution No. 2 in Table 2.

As a result of dipping for 1 hr with stirring at 60° C., a bright yellow semigloss gold coating having a thickness of 0.8 μm was obtained. The coating thus obtained had a uniform appearance without unevenness, and did not peel off in a tape test, thus showing good adhesion. When a test circuit board with a wiring pattern was plated in the same manner, a bright yellow semigloss gold coating having no unevenness in detailed areas was obtained.

The stability was evaluated by further stirring at 60° C. with no load. Gold micro particles were formed after 40 hours had elapsed.

Comparative Example 3

An Ni—P coating was formed on a copper plate by the procedure of the reference example using ICP Nicoron GM manufactured by Okuno Chemical Industries Co., Ltd., then subjected to displacement gold plating using Muden Gold AD (manufactured by Okuno Chemical Industries Co., Ltd.), and subjected to electroless gold plating using solution No. 3 in Table 2.

As a result of dipping for 1 hr with stirring at 60° C., a bright yellow semigloss gold coating having a thickness of 0.2 μm was obtained. The coating thus obtained had unevenness and a nonuniform appearance. When a test circuit board with a wiring pattern was plated in the same manner, uneven deposition or no deposition was observed in detailed areas.

The stability was evaluated by further stirring at 60° C. with no load. No gold micro particles were formed even after 130 hours had elapsed, and good stability was thus exhibited.

It was confirmed that by adding 10 mg/L MBI a good deposition appearance in detailed areas could not be obtained.

Comparative Example 4

An Ni—P coating was formed on a copper plate by the procedure of the reference example using ICP Nicoron GM manufactured by Okuno Chemical Industries Co., Ltd., and then subjected to electroless gold plating using solution No. 4 in Table 2.

As a result of dipping for 1 hr with stirring at 60° C., a bright yellow semigloss gold coating having a thickness of 0.3 μm was obtained. The coating thus obtained had unevenness and a nonuniform appearance. When a test circuit board with a wiring pattern was plated in the same manner, uneven deposition or no deposition was observed in detailed areas.

The stability was evaluated by further stirring at 60° C. with no load. Gold micro particles were formed after 30 hours had elapsed.

It was confirmed that even when cytosine was added, if the pH was 6.0, there was instability.

Comparative Example 5-1

An Ni—P coating was formed on a copper plate by the procedure of the reference example using ICP Nicoron GM manufactured by Okuno Chemical Industries Co., Ltd., and then subjected to electroless gold plating using solution No. 5-1 in Table 2.

As a result of dipping for 1 hr with stirring at 60° C., a bright yellow semigloss gold coating having a thickness of 0.2 μm was obtained. The coating thus obtained had a uniform appearance without unevenness, and did not peel off in a tape test, thus showing good adhesion. When a test circuit board with a wiring pattern was plated in the same manner, a bright yellow semigloss gold coating having no unevenness in detailed areas was obtained.

The stability was evaluated by further stirring at 60° C. with no load. Gold micro particles were formed after 6 hours had elapsed.

Comparative Example 5-2

An Ni—P coating was formed on a copper plate by the procedure of the reference example using ICP Nicoron GM manufactured by Okuno Chemical Industries Co., Ltd., and then subjected to electroless gold plating using solution No. 5-2 in Table 2.

As a result of dipping for 1 hr with stirring at 60° C., almost no gold coating was obtained. Similarly, when a test circuit board with a wiring pattern was plated in the same manner, almost no gold coating could be obtained.

The stability was evaluated by further stirring at 60° C. with no load. No gold micro particles were formed even after 130 hours had elapsed, and good stability was thus exhibited.

It was confirmed that an effect on the deposition rate and a good deposition appearance in detailed areas could not be obtained by adding 1000 mg/L of 1,10-phenanthrolinium chloride.

Comparative Example 6

An Ni—P coating was formed on a copper plate by the procedure of the reference example using ICP Nicoron GM manufactured by Okuno Chemical Industries Co., Ltd., and then subjected to electroless gold plating using solution No. 6 in Table 2.

As a result of dipping for 1 hr with stirring at 60° C., a bright yellow semigloss gold coating having a thickness of 0.36 μm was obtained. The coating thus obtained had a uniform appearance without unevenness, and did not peel off in a tape test, thus showing good adhesion. When a test circuit board with a wiring pattern was plated in the same manner, a bright yellow semigloss gold coating having no unevenness in detailed areas was obtained. The stability was evaluated by further stirring at 60° C. with no load. Gold micro particles were formed after about 80 hours had elapsed.

TABLE 1

Table 1 Examples

| | (units) | Example No. 1 | 2 | 3 | 4 | 5 | 6 |
|---|---|---|---|---|---|---|---|
| Substrate | | Cu/Ni—P/Au | Cu/Ni—P/Au | Cu/Ni—P/Au | Cu/Ni—P/Au | Cu/Ni—P | Cu/Ni—P/Au |
| Potassium sulfite | mol/L | 0.50 | 0.64 | 0.64 | 0.64 | — | 0.64 |
| Sodium sulfite | mol/L | — | — | — | — | 0.32 | — |

TABLE 1-continued

Table 1 Examples

| | (units) | Example No. 1 | 2 | 3 | 4 | 5 | 6 |
|---|---|---|---|---|---|---|---|
| Sodium thiosulfate | mol/L | 0.08 | 0.10 | 0.10 | 0.10 | 0.08 | 0.10 |
| Potassium dihydrogen phosphate | mol/L | 0.20 | 0.20 | 0.10 | 0.20 | — | 0.20 |
| Potassium tetraborate | mol/L | — | — | — | — | 0.05 | — |
| Potassium iodide | mol/L | 0.10 | | | 0.01 | — | 0.01 |
| Sodium L-ascorbate | mol/L | 0.10 | 0.075 | 0.075 | 0.10 | — | 0.05 |
| Hydroxylamine hydrochloride | mol/L | — | — | — | — | 0.05 | — |
| Gold sodium sulfite | M as Au | 0.01 | 0.0075 | 0.0075 | 0.01 | 0.01 | 0.005 |
| Cytosine | mg/L | 1000 | 1000 | — | 5000 | 1000 | 3000 |
| 5-Methylcytosine hydrochloride | Mg/L | — | — | 1000 | — | — | — |
| pH | | 7.15 | 8.0 | 8.0 | 8.0 | 9.0 | 7.0 |
| Bath temperature | ° C. | 60 | 60 | 60 | 60 | 60 | 60 |
| Gold deposition rate | μm/h | 0.9 | 0.8 | 0.9 | 0.7 | 0.2 | 0.3 |
| Stability at 60° C. | | Good | Good | Good | Good | Good | Good |
| Appearance in detailed areas | | Good | Good | Good | Good | Good | Good |

TABLE 2

Table 2 Comparative Examples

| | Comparative Example No. 1 | 2 | 3 | 4 | 5-1 | 5-2 | 6 |
|---|---|---|---|---|---|---|---|
| Substrate plated (units) | Cu/Ni—P/Au | Cu/Ni—P/Au | Cu/Ni—P/Au | Cu/Ni—P/Au | Cu/Ni—P | Cu/Ni—P | Cu/Ni—P/Au |
| Potassium sulfite (mol/L) | 0.50 | 0.64 | 0.64 | 0.64 | — | — | 0.64 |
| Sodium sulfite (mol/L) | — | — | — | — | 0.32 | 0.32 | — |
| Sodium thiosulfate (mol/L) | 0.08 | 0.10 | 0.10 | 0.10 | 0.08 | 0.08 | 0.10 |
| Potassium dihydrogen thiosulfate (mol/L) | 0.20 | 0.20 | 0.20 | 0.20 | — | — | 0.20 |
| Potassium tetraborate (mol/L) | — | — | — | — | 0.05 | 0.05 | — |
| Potassium iodide (mol/L) | 0.01 | 0.01 | 0.01 | 0.01 | — | — | 0.01 |
| Sodium L-ascorbate (mol/L) | 0.10 | 0.075 | 0.10 | 0.075 | — | — | 0.05 |
| Hydroxylamine hydrochloride (mol/L) | — | — | — | — | 0.05 | 0.05 | — |
| Gold sodium sulfite (mol/L) | 0.01 | 0.0075 | 0.01 | 0.0075 | 0.01 | 0.01 | 0.005 |
| Cytosine (ppm) | — | — | — | 1000 | — | — | — |
| 1,10-Phenantholinium chloride (ppm) | — | — | — | — | — | 1000 | — |
| MBI (ppm) | — | — | 10 | — | — | — | — |
| PH | 7.15 | 8.0 | 7.20 | 6.0 | 9.0 | 9.0 | 7.15 |
| Bath temperature (° C.) | 60 | 60 | 60 | 60 | 60 | 60 | 60 |
| Gold deposition rate (μm/h) | 0.9 | 0.8 | 0.2 | 0.3 | 0.2 | 0 (substantially stopped) | 0.36 |
| Stability at 60° C. | Fair | Fair | Good | Fair | Poor | Good | Fair |
| Appearance in detailed areas | Good | Good | Poor | Poor | Good | — | Good |

Effects of the Invention

The present invention can provide an electroless gold plating solution that is stable, does not cause bath decomposition and, even when it is used in excess, does not greatly suppress the gold deposition rate.

What is claimed is:

1. An electroless gold plating solution that contains no cyanide compound as a source of gold and that contains a decomposition inhibitor, represented by general formula (1), provided that, in a case in which the solution contains a gold complex of sulfite and the decomposition inhibitor is cytosine, the pH 6.0 or less is excluded, (1)

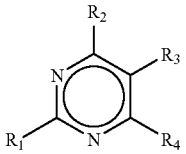

and in the formula, $R_1$ to $R_4$ denote hydrogen atom(s), alkyl groups having 1 to 10 carbon atom(s), which may have substituent(s), aryl group(s) having 6 to 10 carbon atoms, which may have substituent(s), alkoxy group(s) having 1 to 10 carbon atom(s), which may have substituent(s), amino group(s) (—$NH_2$), hydroxyl group(s) (—OH), ═O, or halogen atom(s), $R_2$ and $R_3$ or $R_3$ and $R_4$ may crosslink with each other and form a saturated or unsaturated ring and the saturated or unsaturated ring may include oxygen, sulfur or nitrogen atom(s), each of the above-mentioned substituents is a halogen atom or a cyano group, and is a single bond or a double bond.

2. The electroless gold plating solution according to claim 1, wherein the decomposition inhibitor is cytosine or 5-methylcytosine.

3. The electroless gold plating solution according to claim 1, wherein the rate of gold deposition on a substrate metal is 60% to 100% of that when no decomposition inhibitor is added.

4. The electroless gold plating solution according to claim 1, wherein it further includes a complexing agent, a source of gold, and a reducing agent.

5. The electroless gold plating solution according to claim 1, wherein the source of gold is selected from the group consisting of a gold complex of sulfite, a gold complex of thiosulfate, chloroauric acid or a salt thereof, a thiourea gold complex salt, a gold complex salt of thiomalic acid, and a gold iodide salt.

6. An electroless gold plating method wherein electroless gold plating is carried out by dipping a material to be plated in the electroless gold plating solution according to claim 1.

7. An electroless gold plating method wherein electroless gold plating is carried out by dipping a material to be plated in the electroless gold plating solution according to claim 2.

8. An electroless gold plating method wherein electroless gold plating is carried out by dipping a material to be plated in the electroless gold plating solution according to claim 3.

9. An electroless gold plating method wherein electroless gold plating is carried out by dipping a material to be plated in the electroless gold plating solution according to claim 4.

10. An electroless gold plating method wherein electroless gold plating is carried out by dipping a material to be plated in the electroless gold plating solution according to claim 5.

11. The electroless gold plating solution according to claim 2, wherein the rate of gold deposition on a substrate metal is 60% to 100% of that when no decomposition inhibitor is added.

* * * * *